United States Patent [19]

Hoffman, Jr.

[11] Patent Number: 5,076,434

[45] Date of Patent: Dec. 31, 1991

[54] SUPPORTING CONTAINER FOR PIZZA DOUGH SHELLS AND A PACKAGE FOR THE SAME FORMED BY THE CONTAINER

[75] Inventor: Donald J. Hoffman, Jr., Melville, Mo.

[73] Assignee: Gap Container Corporation, St. Louis County, Mo.

[21] Appl. No.: 614,278

[22] Filed: Nov. 15, 1990

Related U.S. Application Data

[63] Continuation of Ser. No. 442,691, Nov. 29, 1989, abandoned.

[51] Int. Cl.[5] ..... B65D 85/62

[52] U.S. Cl. ..... 206/509; 206/511; 206/518; 206/503; 206/551; 99/450; 99/DIG. 15

[58] Field of Search ..... 206/503, 509, 512, 518, 206/551, 557, 562, 511; 220/23.83; 99/450, DIG. 15

[56] References Cited

U.S. PATENT DOCUMENTS

| | | | |
|---|---|---|---|
| 73,703 | 1/1868 | Elder | 99/DIG. 15 |
| 1,021,640 | 3/1912 | Steitler | 99/DIG. 15 |
| 1,781,302 | 11/1930 | Roberts | 99/DIG. 15 |
| 1,945,397 | 1/1934 | Gray | 99/DIG. 15 |
| 3,098,597 | 7/1963 | Johnson et al. | 99/DIG. 15 |
| 3,318,283 | 5/1967 | Maclam et al. | 206/557 |
| 3,335,846 | 8/1967 | Mills | 206/551 |
| 3,379,340 | 4/1968 | Silvio | 206/509 |
| 3,398,827 | 8/1968 | Laskin | 206/551 |
| 3,480,177 | 11/1969 | Elliot | 206/509 |
| 3,509,813 | 5/1970 | Appelt | 99/DIG. 15 |
| 3,549,018 | 12/1970 | Wilson | 206/509 |
| 3,715,218 | 2/1973 | Feely | 206/557 |
| 3,771,713 | 11/1973 | Davidson | 206/602 |
| 4,144,968 | 3/1979 | Shelton | 206/509 |
| 4,176,591 | 12/1979 | Power | 99/450 |
| 4,184,421 | 1/1980 | Ahgren | 99/DIG. 95 |
| 4,373,636 | 2/1983 | Hoffman | 206/551 |
| 4,441,615 | 4/1984 | Goodrich | 206/512 |
| 4,563,946 | 1/1986 | Barlow et al. | 99/450 |
| 4,677,905 | 7/1987 | Johnson | 99/450 |
| 4,733,779 | 3/1988 | Hubmann et al. | 206/557 |
| 4,811,846 | 3/1989 | Bottega | 206/551 |
| 4,865,219 | 9/1989 | Logan et al. | 99/DIG. 15 |

*Primary Examiner*—David T. Fidei

*Attorney, Agent, or Firm*—Gravely, Lieder & Woodruff

[57] ABSTRACT

A pizza dough shell container which makes up into a package having a plurality of similar containers supporting a single pizza dough shell in each container so that by forming a package of many containers the pizza dough shells are protected during transit to a place of sale and at the same time the shells are free to relax and undergo some shrinkage but are free to be removed from the containers to supply the demand.

7 Claims, 5 Drawing Sheets

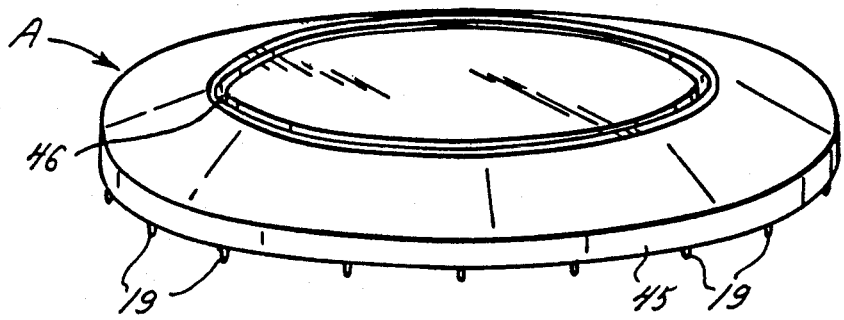
FIG. 10.
FIG. 11.
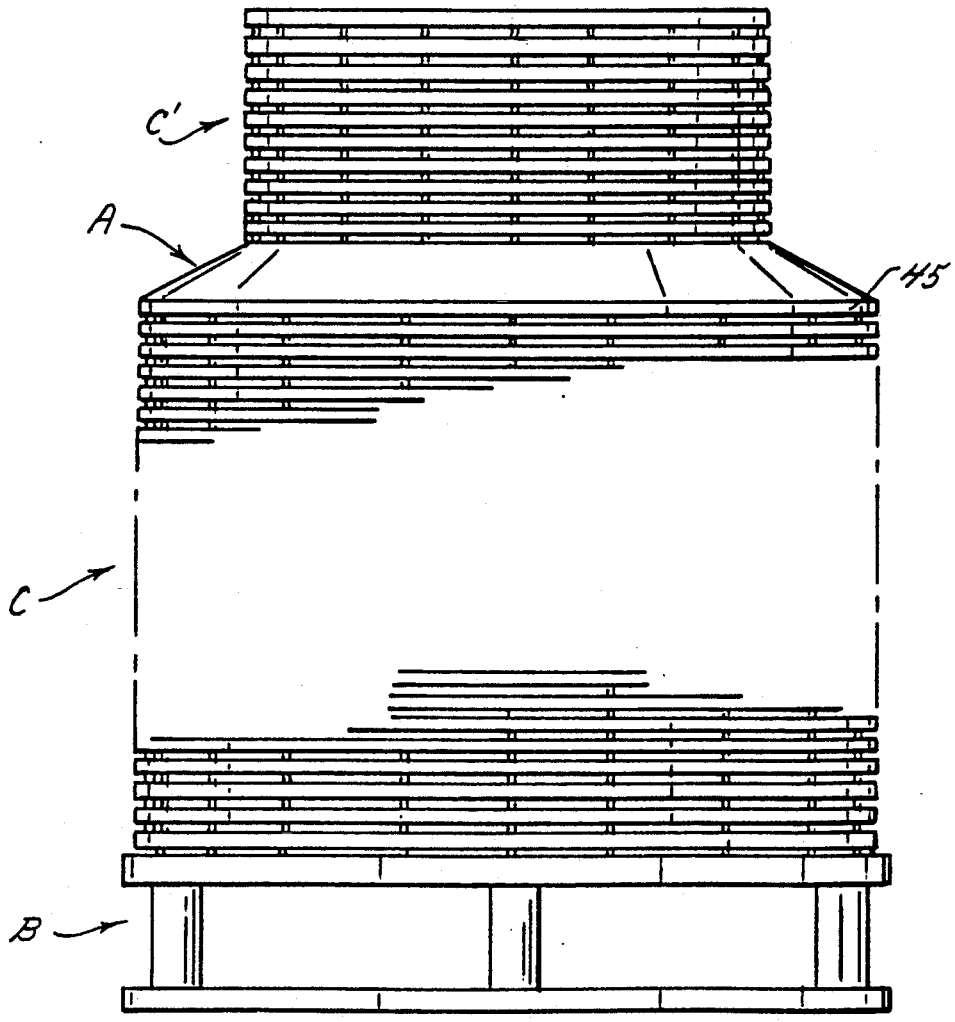

FIG. 12.
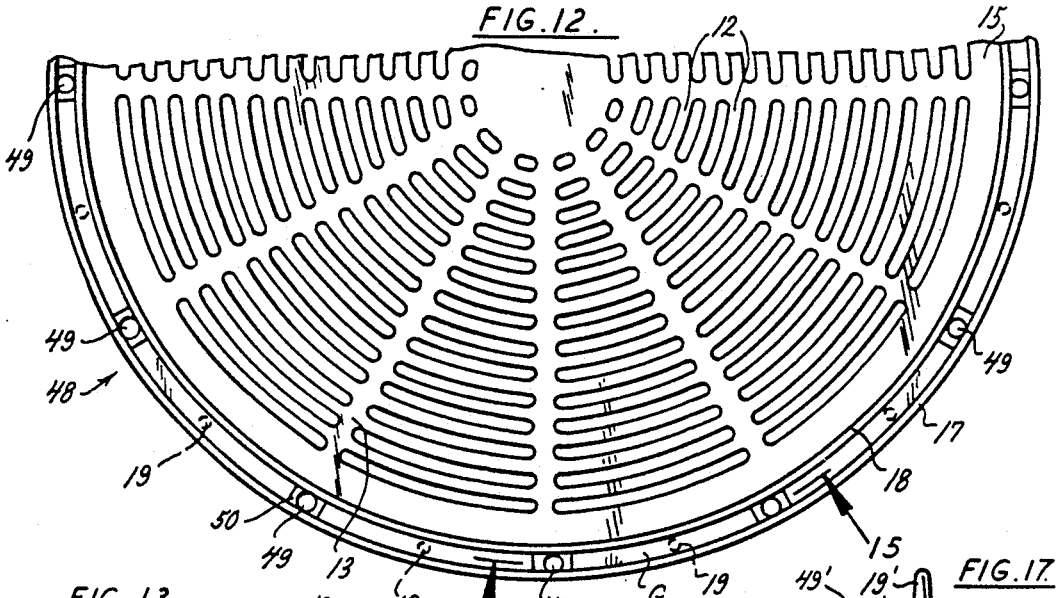
FIG. 13.
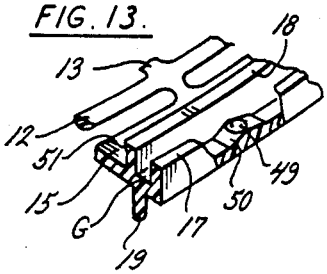
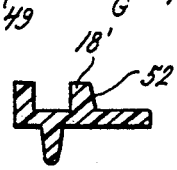
FIG. 16
FIG. 17.
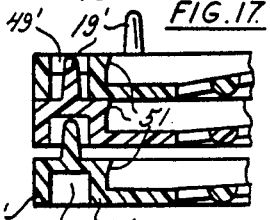
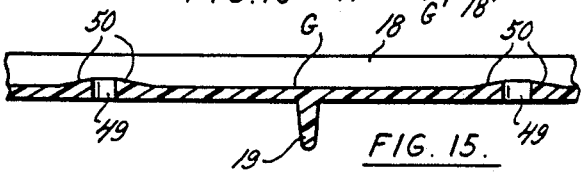
FIG. 15.
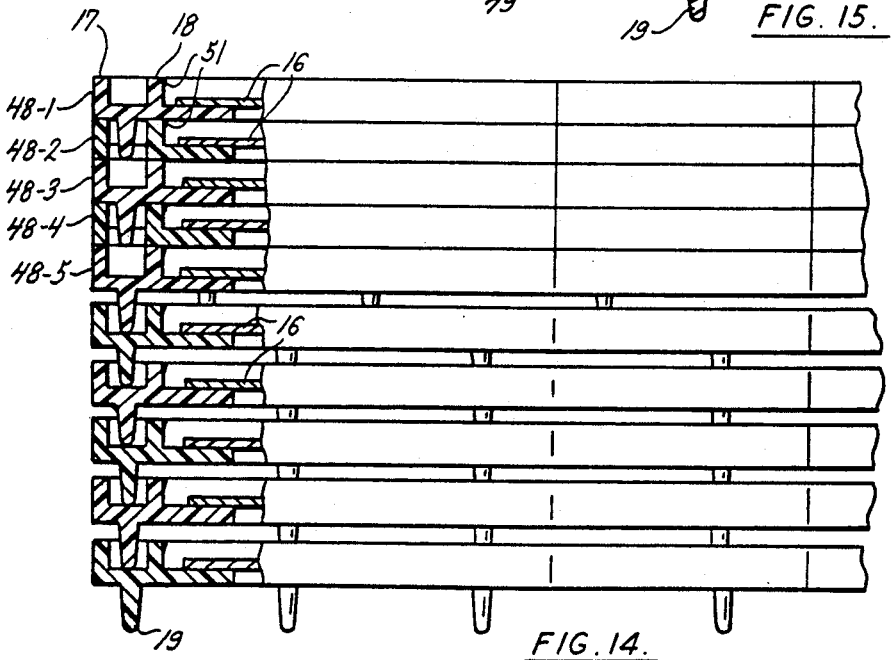
FIG. 14.

SUPPORTING CONTAINER FOR PIZZA DOUGH SHELLS AND A PACKAGE FOR THE SAME FORMED BY THE CONTAINER

This is a continuation of copending application Ser. No. 07/442,691 filed on Nov. 29, 1989 now abandoned.

BACKGROUND OF THE INVENTION

This invention is concerned with the support of and packaging and transporting of pizza dough shells, and with a unique container for the protection of dough shells.

A major concern that this invention aims to solve is how to provide dough shells with protection against contamination until actually used, and how to keep dough shells substantially fresh for extended periods of time.

The storage and shipping problems are particularly acute in the business of making and handling pizza dough shells. The container type packaging set forth in this invention is capable of providing cooled storage and protection for pizza dough shells made by either cross rolling, by extruding, or by pressing. When pizza dough shells are made by hand they have to be used promptly or the fresh condition is lost.

When containers of this invention are used, it will allow a commissary type operation to make fresh dough shells that can be delivered to individual stores in condition that maintains them cooled as if freshly made. Stores or pizza outlets making use of dough shells that are cooled and received in containers of this invention are able to gain a benefit in providing customers of the store outlets with shells that are fresh, and gain added advantage in being able to advertise fresh not frozen dough shells.

Heretofore, attempts have been made to provide dough shells packaged in stacks by placing wax paper between the shells, but that has resulted in the wax paper sticking to the shells. There are other problems in that the bottom shell of a stack will be different from the shell above and the top shell will be different so that no two shells will be alike.

BRIEF DESCRIPTION OF THE INVENTION

A primary object of the invention is to promote the distribution of pizza dough shells in a fresh condition by providing a container to support the shells so that air circulation is possible to retard the action of the dough and to be able to ship shells in stacks that makes it easy to handle.

Another object of the invention is to be able to support pizza dough shells separately so that each shell can relax and shrink while retarding by stiffening up since it is not frozen.

A further object of the invention is to create a dough carrier in a form that will meet casting techniques in metal or plastic for economy of manufacture and adaptability to needs in the pizza dough shell field or for other handling needs.

Other objects of the invention are to provide containers that support individual dough shells in multi-container stacks for volume transportation to stores, to form the containers so they space the dough shells apart for air circulation, interconnect containers in stacks so the stacks are stabilized against tipping, to be able to subject the contents of the container to be cooled at the outlet stores, and then to close the containers so the cooling effect is retained for a period of time by the double-walled insulation effect of the rim so a stack of containers can be placed on a counter without loosing the cooled condition.

BRIEF DESCRIPTION OF THE EMBODIMENTS

The drawing illustrates a typical pizza dough shell container which is formed to support dough shells of any of the sizes of shells, wherein each container has the following characteristics:

FIG. 10 is a perspective view of an adapted to allow the packaging of different sizes of containers in one stack;

FIG. 11 is a side elevation of a package having different sizes of containers;

FIG. 12 is a fragmentary plan view of a modified container adapted for cooling dough shells while in the containers, and providing a way of closing a stack of containers with cooled dough shells to retain the cooling effect;

FIG. 13 is a fragmentary detail of the container seen in FIG. 12;

FIG. 14 is a fragmentary elevational view of a stack of modified containers to illustrate the selective closing of several containers while the remainder stay open;

FIG. 15 is a fragmentary developed view taken along line 15–15 in FIG. 12;

FIG. 16 is a modification of the flanged and pin provision of FIG. 12 and FIG. 17 is a fragmentary view of a stack of modified containers.

DETAILED DESCRIPTION OF THE EMBODIMENT

Figure 1:
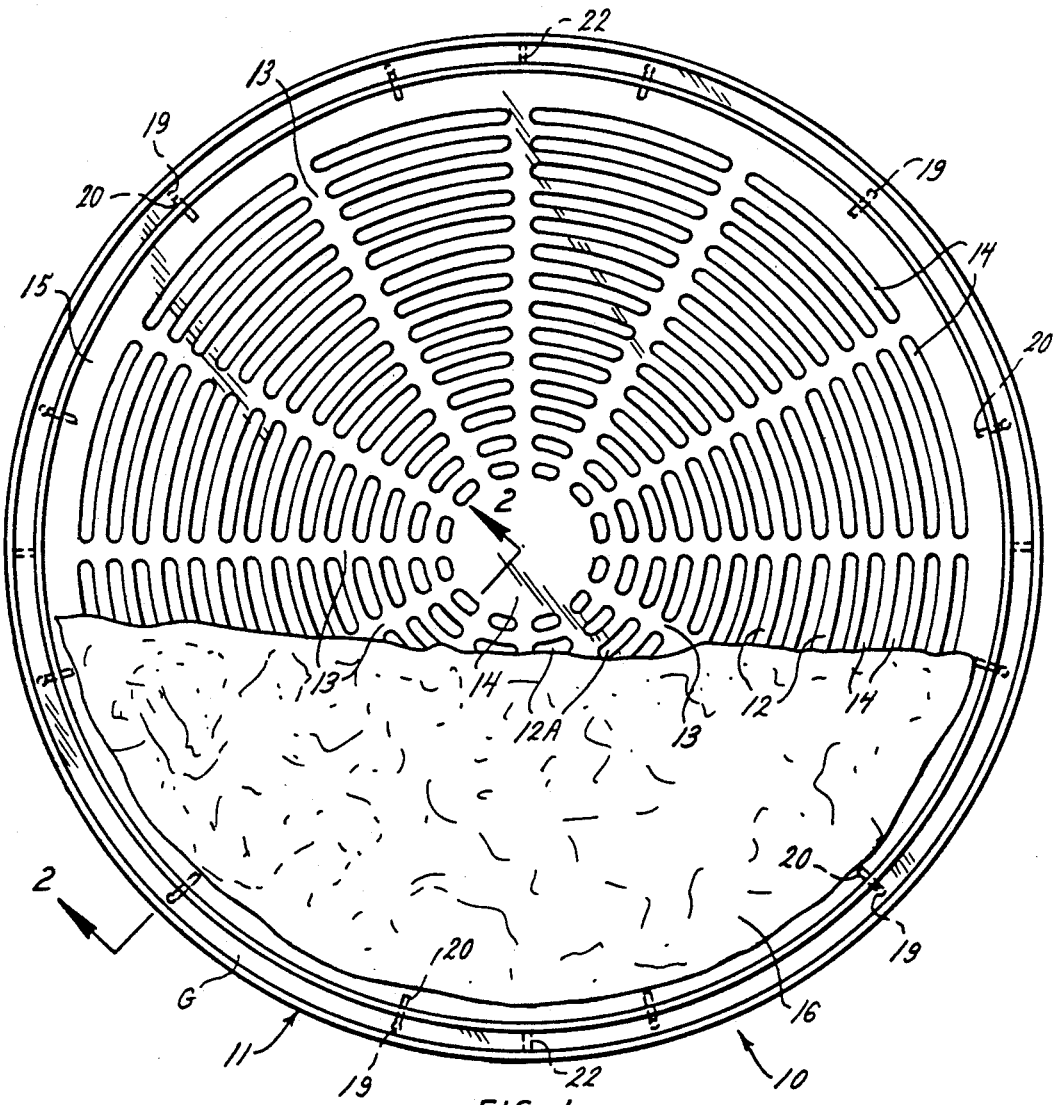
FIG. 1 is a plan view of a container having a shell supporting framework made up of a series of circular and radial bars enclosed by a channelled circular rim.
Figure 2:
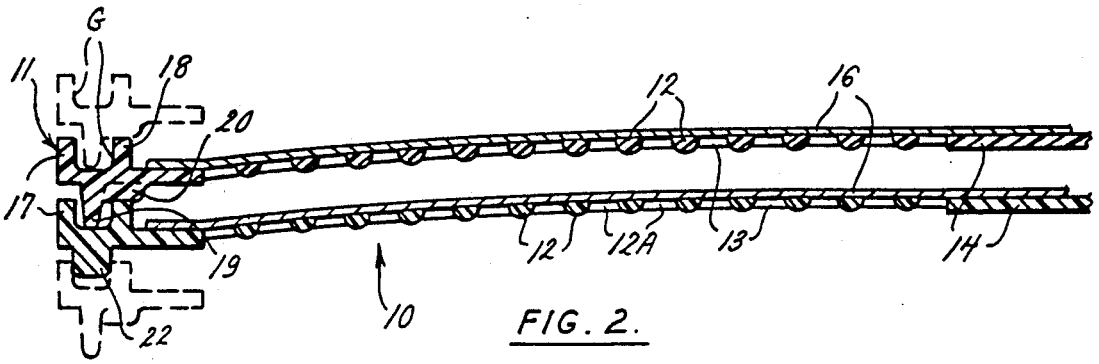
FIG. 2 is a sectional elevation of a portion of at least two containers showing the interlocking construction of the circular rim, the view being taken along line 2—2 in FIG. 1.

Referring now to FIGS. 1 and 2 of the drawings, there is shown in the plan view a typical container 10 having a circular rim structure 11 surrounding and enclosing a framework made up of a series of circular bars 12 spaced apart to form openings 12A and radially directed bars 13. The radially directed bars 13 radiate outwardly from a center gate location 14 and are connected to a portion 15 of the rim 11 so that the series of circular and radial bars, together with the rim portion 15, make up a supporting surface for a dough shell. Openings 14 between the bars 12 and 13 expose a dough shell 16 to air. A typical dough shell has been shown in FIG. 2 as overlying the series of bars. The container 10 is produced by injection molding methods with the plastic injected at a patch which was the location for a gate.

The rim 11 of a container 10 is shown in great detail in FIG. 2 as being made up of a perimeter flange 17 and radially inwardly spaced is a flange 18 which defines the limits of the margin of a dough shell. It can be seen in FIG. 2 that the perimeter flange 17 and the limiting flange 18 project upwardly to the same side of the container 10 that exposes the dough shell for support. The underside of the flanges 17 and 18 is formed with a series of spacer pins 19 which are adapted to be received between the flanges 17 and 18 of an underlying container 10 so that the dough shell supporting surfaces are retained in spaced relationship. The pin length can vary to match the desired spacing between containers. Each pin 19 is formed with a radially inwardly directed stop element 20 which has a suitable length and is in position to engage on the upper surface of the flange 18 of an underlying container 10. The pins 19 are shown in FIG. 1 as being spaced around the circular limits of the container, and the stop elements are also shown in phantom in connection with the pins 19.

Figure 3:
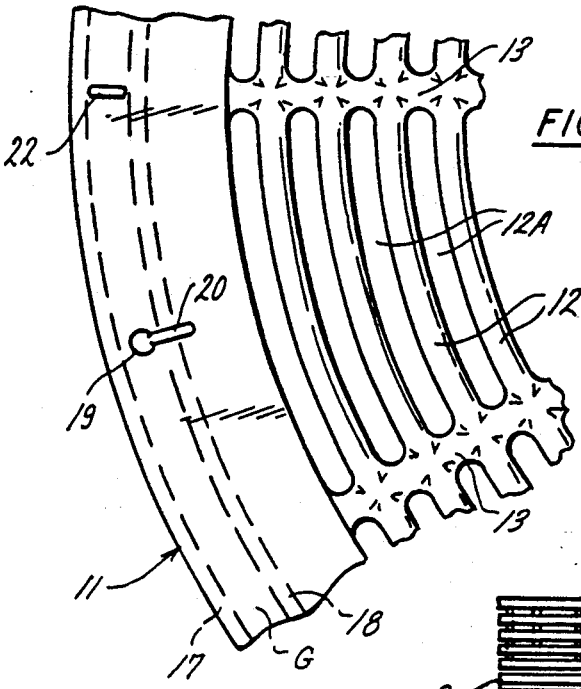
FIG. 3 is a fragmentary portion of a container looking up from the under side.
Figure 4:
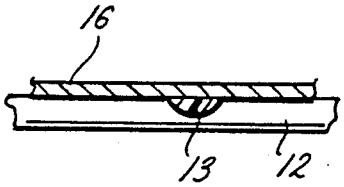
FIG. 4 is a fragmentary sectional view of a portion of the circular and radial bars showing the curved sides thereof.
Figure 5:
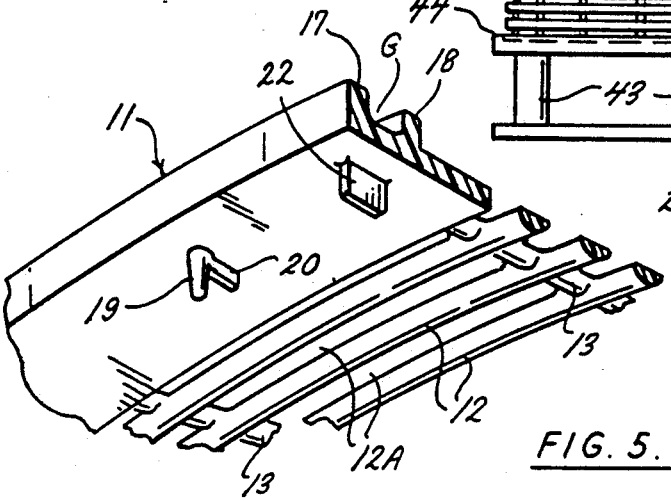
FIG. 5 is an enlarged and fragmentary perspective view of the underside of a container.

Each container is produced either by metal casting methods or in a molding operation using plastic. In either case, the container 10 may be characterized in which the radial bars 13 are given an upwardly arched configuration and are also formed with a flat upper face and a lower curved face for the purpose of strengthening the load supporting characteristic. In a like manner the circularly directed bars 12 have a flat upper face and a curved lower face. The described bars 12 and 13 and the flange 15 are best seen in FIGS. 3 and 5, while the pins 19 and the stop elements 20 associated with those pin elements is shown in FIG. 2.

Figure 7:
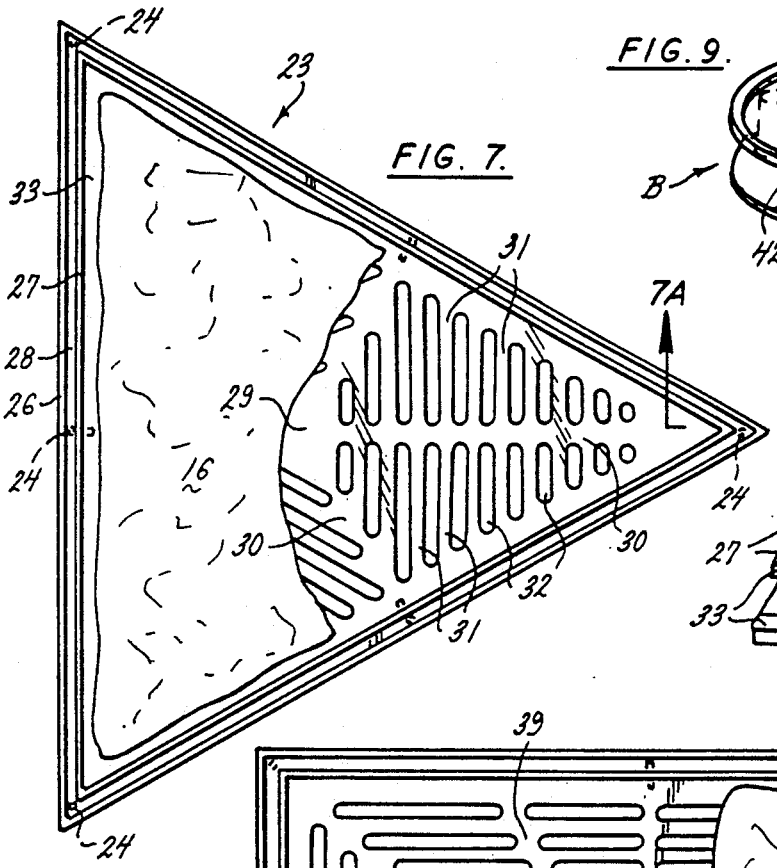
FIG. 7 is a plan view of a triangular or pie shaped container for individualizing dough shells.
Figure 9:
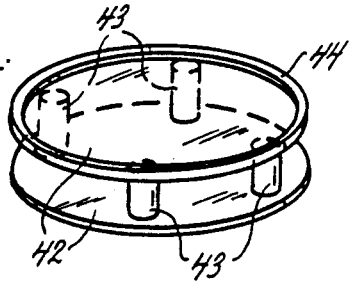
FIG. 9 is a perspective view of a base upon which stacks of dough shell containers may be stacked and picked up on a typical two-wheel dolly.

Turning now to FIG. 7 it is seen that the container 23 for dough shells has straight segments to constitute a pie or triangular shape for individualizing the shells. A group of containers 23 can be assembled on a round or straight sided starter container, and thereafter the same grouping can be assembled for each layer during the stacking. Each container 23 (See FIG. 7A) is formed with a corner pin 24 and a stop element 25 so that in stacking the flanges 26 and 27, which are spaced to form a perimeter groove 28, to provide a space for reception of the pins 24, and the stop element 25 engages on the inner flange 27. The length of the pins 24 may be varied as desired to determine the spacing between containers 23 when in a stack thereof.

Each container 23 may be formed by metal casting technique or by injection molding through a suitable gate represented by the residual patch 29 in a center location. The bars 30 and lateral ribs 31 which make up the surface have air openings 32 to receive a dough shell seen at 16. It is to be noted that the inner flange 27 is adjacent a horizontally directed flange or lip 33 that becomes the edge limit for a dough shell 16 in the surface of the container 23 where it meets the lip 33.

Figure 7A:
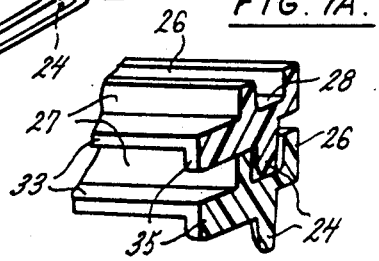
FIG. 7A is a fragmentary perspective sectional view of a pin connection between adjacent containers, the view being taken along lines 7A—7A in FIG. 7 at one corner, but will be typical for each corner.
Figure 8:
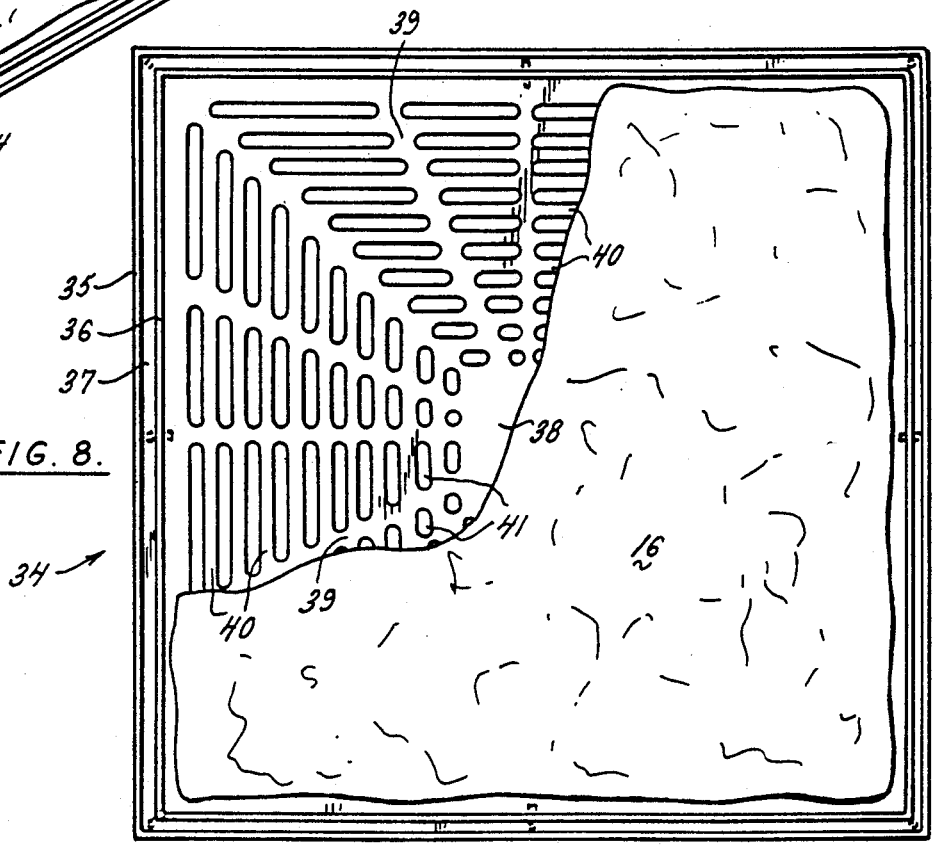
FIG. 8 is a plan view of a rectangular dough shell container have the characteristics similar to the round container seen in FIG. 1.

A further configuration for a container 34 is seen in FIG. 8 which is square in plan, although a rectangular shape is the equivalent. In the square type container 34, the perimeter sides are straight segments formed with spaced flanges (See FIG. 7A) 35 and 36 to form a notch space 37 between the flanges. Each container 34 is provided with a suitable number of spacer pins 24 and stop elements before noted in FIG. 7A. The dimensions of the pins and stop elements may vary to meet the stacking conditions as to spacing between containers 34.

The container 34 has a support surface for a dough shell 16 made up of a central patch 38 where the casting gate is located. Bars 39 extend outwardly to the corners and sides from the patch toward the flanges 36, and lateral bars 40 extend between bars 39 to define openings 41 for air flow which comes up under the dough shell 16.

While the containers of FIGS. 1, 23 and 34 are indicated to be formed by injection of suitable plastic, it is within the scope of the invention to make the containers as a metal casting to yield the equivalent results in all respects for support of dough shells. Working requirements in the transport of dough will ordinarily dictate the selection of metal or plastic materials.

Figure 6:
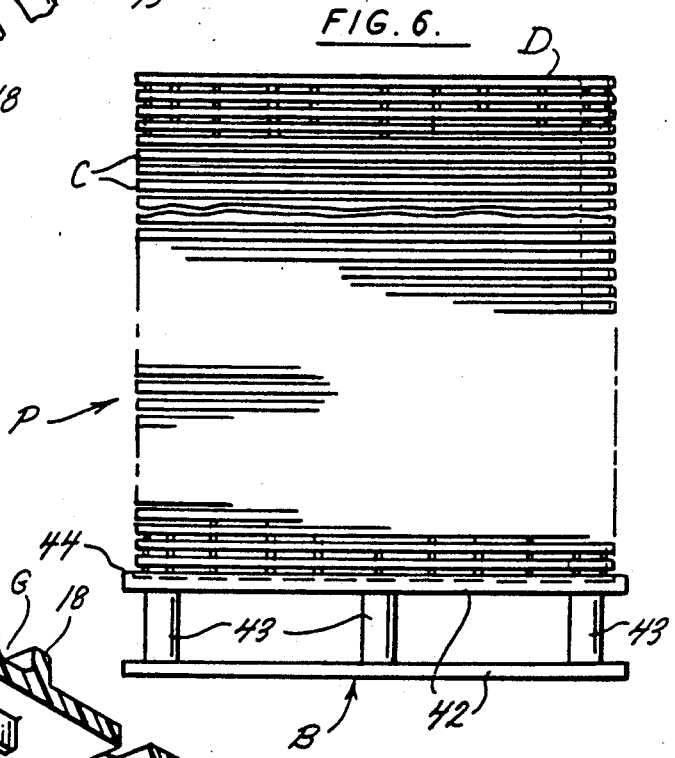
FIG. 6 is a side elevation of a package made up of a stack of containers.

A feature of the present invention is illustrated in FIG. 6 where a plurality of containers C are placed in a stacked relationship to form a package P in which each individual container of the package supports a single dough shell 16. As seen in FIG. 2, the stack of containers are spaced apart so that air can flow between the containers. Referring again to FIG. 5 there is seen a stack stabilizing element 22 which is located at least at 4 spaces around the rim of each container for stabilizing the package of containers against lateral misalignment. The stack is supported on a base B which may be a pair of flat plates 42 held in spaced relation by column 43. After a stack as been formed upon the base, it can be moved with the aid of a standard type two-wheel dolly by tipping the stack just enough to allow the foot of the dolly to be slipped under the bottom plate 42. The top one of the plates 42 has a raised rim 44 to retain the stack of containers, and the top of the stack is closed by a blank disc D.

A further feature of the present invention is illustrated in FIGS. 10 and 11 where a plurality of containers 10 of a first predetermined size can be stacked up on a base B to a predetermined number of containers, and thereafter a different smaller size predetermined stack of containers c' can be added to the top of the stack by means of an adapter A. The adapter A is seen in FIG. 10 to comprise a base rim 45 having spacer pins of the type seen at 19 in FIG. 2 or at 24 as seen in FIG. 7A. The adapter body is solid and is sloped upwardly to a smaller groove 46 which is of a size to receive one or more spacer pins 19 or 24 depending upon whether the smaller containers are circular or triangular.

While the adapter of FIG. 10 is round, a similar type adapter may be provided for a stack of the containers 34 of square or rectangular shape depicted in FIG. 8. Suitable spacer pins are, of course, formed on the underside of the container of FIG. 8 as shown at 47. The adapter for square or rectangular containers will of course have a similar size rim formation for receiving spacer pins projecting from the similar size containers. Having shown in FIG. 10 a type adapter, it is not believed necessary to burden the present description and drawings with an adapter of the square or rectangular character.

A still further feature of this invention is seen in FIGS. 12, 13, 14 and 15 where a circular container 48 of the type 10 first described in FIG. 1 is formed with a surface made up of bars 13, lateral ribs 12, and a lip 15 on the inner flange 18. The outer perimeter flange 17 is spaced from the inner flange 18 to form the circumferential groove G. In this modified container 48 the groove G is formed with a series of holes 49 which open through the groove at circumferential spaces about midway between the pins 19. There are as many holes 49 as there are pins 19, and each hole (See FIGS. 13 and 15) in the groove is formed in a slightly raised ramp 50 from opposite approaches. The ramps 50 are intended to offer sufficient impediment to the pins 19 being jostled or vibrated in the groove G to work into the holes 49. Such jostling and vibrations can result from rough handling when loading a truck to a store, or it can be vibration in the truck during transportation.

The feature of the holes 49 and ramps 50 in the grooves G of each container 48 serves the purpose of allowing the containers, when in a stacked condition of FIG. 6 or FIG. 11, to be turned or rotated so the pins 19 are caused to be moved in the groove G to drop into the holes 49 whereby the adjacent containers drop down against each other and close off the access of air flow between the containers. That feature is seen in FIG. 14 where the top four containers 48-1 to 48-4 are rotated until they close down on the fifth container 48-5. The underpositioned containers are not rotated and thus remain spaced apart to allow for air movement between them.

The feature of allowing the pins 19 to drop into holes 48 accomplishes the unique advantage that after the stack of spaced containers 48 have been subjected to a cooling atmosphere (not a freezing temperature), a preselected group of containers can be rotated to close down on each other and thereby form a closed stack to retain the cooled dough shells for a sufficient time after being removed from the cooling atmosphere. The advantage is that the outlet stores, where pizza is sold to the ultimate customer, do not require expensive refrigeration equipment. Such stores can receive precooled stack of containers with dough shells, already cooled at the commissary, and will only need a cooled room. After receiving precooled stacks of containers, the store operator can place a closed group of containers on a counter and dispense the top one each time to a customer. The result is that the closed containers will retain the cooling temperature right on the counter until taken off to receive the type of ingredients ordered by a customer and then cooked to that order.

Yet another feature of the invention resides in the adaptability of the containers to retain the dough shells 16 in position by the presence of a retainer lip 51 on the top margin of the inner flange 18 as shown in FIG. 13–15 and 17. The lip 51 checks the edge of a dough shells 16 from being vibrated or displaced on the grid surface 12, 13 and 15 so that edge rids up and over the flange 18 so the containers are prevented from being closed up to retain the cooling effect.

The example seen in FIG. 16 is a fragmentary detail on the formation of the inner flange 18' with a slanted surface 52 to accommodate a pan type dough shell.

In addition, it is seen in FIG. 17 that the containers can be formed so the flanges 17' and 18' can be turned down to define a groove G' that is downwardly open to receive an upwardly directed pin 19'. In this modification, the groove G' can have a hole 49' to allow the pin 19' to be received in the hole for closing the adjacent containers upon each other in the same manner as shown in FIG. 14 upon rotation of one or a group of containers.

The process for producing dough shells is fairly well established to the extent that as soon as each dough shell is properly formed by pressing, or by other means, it is subjected to cooling so as to maintain its fresh condition. In some processes the dough is immediately frozen, but in the present inventive concept it is not desirable to freeze the dough shells but merely keep them cool so as not to lose the freshness characteristic.

The advantage obtained by packaging dough shells in a stack of containers has been found to be the most advantageous way to retard, relax, and transport dough shell so that they reach the store in a fresh condition since each dough shell is supported in an open air flow through position. The advantage of the present containers is that they can be used to support either the crossed rolled or extruded method of making dough shells, and it controls consistency of the round shape for each dough shell.

What is claimed is:

1. Container means for supporting dough shells comprising:

(a) a body having a dough shell supporting surface and a surrounding rim formed with an inner flange and an outer flange in spaced apart relation to define a groove therebetween;

(b) spacer means on said body arranged in spaced relation around said rim, said spacer means projecting from said rim opposite to said inner and outer flanges and being sized to fit into a groove of an adjacent body; and (c) openings in said groove sized to receive said spacer means whereby said spacer means enters said openings to allow the closure of one body upon another body.

2. The container means set forth in claim 1 wherein said groove opens in a direction corresponding to the side of said supporting surface which is intended to receive a dough shell, and said inner flange forms a stop for the edges of the dough shell on said support surface.

3. The container means set forth in claim 1 wherein said groove opens in a direction opposite to the side of said supporting surface corresponding to the reception of a dough shell, and said inner flange forms a stop for the edges of a dough shell on said support surface.

4. The container means set forth in claim 1 wherein said dough supporting surface is constituted by a series of spaced apart bars to define openings for exposing the surfaces of a dough shell to air.

5. The container means set forth in claim 1 wherein said surrounding rim is constituted by straight segments which meet in corners.

6. The container means set forth in claim 5 wherein said surrounding rim is constituted by substantially straight segments which meet in corners the included angles of which equal 180°.

7. The container means set forth in claim 5 wherein said surrounding rim is constituted by substantially straight segments which meet in corners the included angles of which equal 360°.

* * * * *